United States Patent [19]

Musgrave

[11] 4,055,015

[45] Oct. 25, 1977

[54] PISTOL CHARGING DEVICE

[76] Inventor: Daniel Dennis Musgrave, 8201 Caraway St., Cabin John, Md. 20731

[21] Appl. No.: 741,715

[22] Filed: Nov. 15, 1976

[51] Int. Cl.[2] ..... F41C 33/04

[52] U.S. Cl. ..... 42/1 R; 224/2 B

[58] Field of Search ..... 42/1 R, 90; 89/1 K; 224/2 B

[56] References Cited

U.S. PATENT DOCUMENTS 3,763,587 10/1973 Firmalino ..... 42/1 R 3,804,306 4/1974 Azurin ..... 224/2 B

*Primary Examiner*—Charles T. Jordan

[57] ABSTRACT

A device for charging a pistol of the type charged by relative motion between a slide and a frame. A ratchet or some equivalent device is installed in a holster, without interfering with normal use of the holster. With the ratchet, the piston can be charged using only one hand, whereas two hands are normally required. Provision is also made for ejecting a cartridge, should one be present when charging takes place.

11 Claims, 5 Drawing Figures

PISTOL CHARGING DEVICE

In the preparation of automatic or semiautomatic weapons for firing, the first cartridge must be moved into position by externally powered means. The process is commonly called charging. The charging process may be arranged so as to cause other preparatory steps, such as the cocking of a firing hammer, to be accomplished simultaneously. But it is immaterial to the present invention if such additional steps result from charging.

This invention is concerned with a particular class of pistols, those having a recoiling slide moving relative to a frame which is non-recoiling to the extent that it is held by the shooter. When the slide is in its forward position it surrounds the top and sides of the barrel except at the muzzle. When the slide recoils it exposes a considerable portion of the barrel which recoils only slightly, or in some designs, not at all. In effect, charging this type of pistol might be said to consist of recoiling the slide by hand and then releasing it to permit a spring in the pistol to return it to its forward position. As one hand must hold the frame, charging such a pistol will normally require two hands.

In addition to preparing to fire, charging is sometimes accomplished for other purposes, such as to eject a defective cartridge which fails to fire, and replace it with another. It may sometimes happen that charging must be done quickly while only one hand is free for this purpose.

In consideration of the foregoing, the principal object of this invention is to provide a charging device for installation in a holster.

This and other objects of the present invention will be apparent upon reference to the following specification, taken in connection with the accompanying drawings, wherein.

Figure 1:
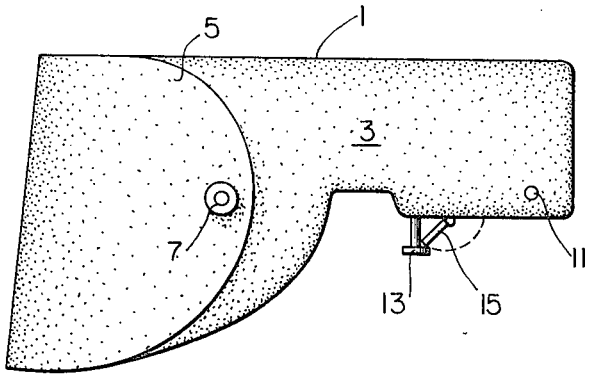
FIG. 1 is an external view of a holster incorporating a charging ratchet.

The various illustrations are for the purpose of disclosure and they should not be considered limiting. A typical pistol is illustrated but the invention can be used with types differing from that shown in the drawings.

Referring now to the drawings in detail, FIG. 1 shows a holster 1 made of any suitable material, such as stiff leather. The holster includes a sheath portion 3, a flap 5, and a fastener 7, which secures the flap to the sheath when the holster is closed.

Figure 2:
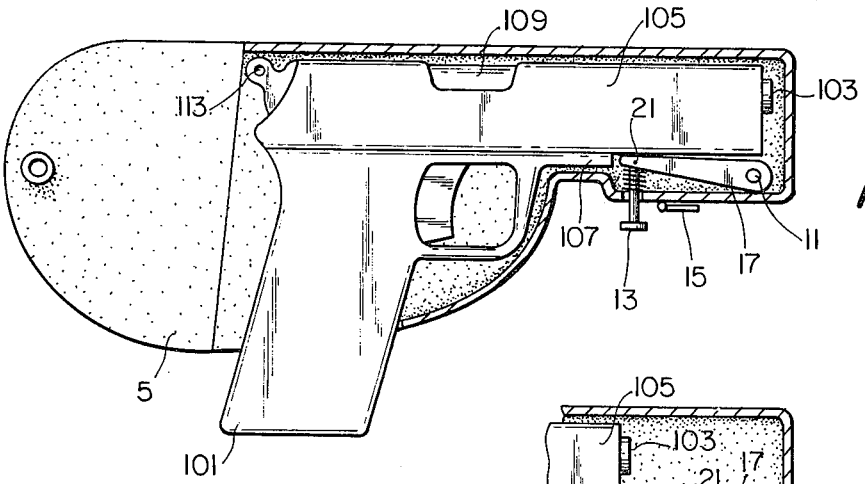
FIG. 2 is a sectional view of a holster incorporating a charging ratchet, with a pistol inserted therein.

As shown in FIG. 2 a pin 11 is mounted transversely in sheath 3 to serve as a pivot for a ratchet 17. Pivotably attached to the ratchet by pin 21 is handle 13 which extends through a suitable hole in the sheath to the exterior of the holster.

Figure 3:
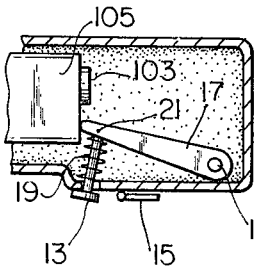
FIG. 3 is a portion of the holster shown in FIG. 2, showing the pistol in a different position.

As may be seen in FIG. 3 the ratchet is spring biased toward a certain position in the sheath by spring 19 which surrounds the shaft of handle 13 and reacts against the wall of the sheath.

On the exterior of the sheath is pivotably mounted a latch 15 which can engage handle 13 and thereby retain the ratchet in a certain position. The position of the latch also serves to indicate to the user whether or not the ratchet is so retained by the latch.

FIG. 2 shows a pistol installed in the holster. The pistol comprises a grip 101, a barrel 103, a slide 105, a frame 107, a hammer 113, and an ejection port 109 formed in the slide. The pistol shown is merely typical, and does not represent any particular model.

As may be seen in FIG. 4, the holster has formed therein a hole 23, the purpose of which is explained hereinafter. The usual type of belt loop (not visible in these drawings) may be provided on the back of the holster, for the purpose of suspending it from the person of a user.

The method of using the holster is as follows. A pistol is installed in the holster (which presumably is suspended from the person of a user) as shown in FIG. 2. While the pistol is being inserted, the ratchet may be latched to its lower, or inoperative position by latch 15 as shown in FIG. 1. The pistol may be inserted with its hammer down, its firing chamber empty, and cartridges in its magazine.

When it is desired to fire, the flap of the holster is opened and the latch, if engaged, is disengaged. The pistol is then drawn partly out of the holster until ratchet 21 engages slide 105 as shown in FIG. 3. As soon as the ratchet engages, grip 101 is pushed toward the sheath, resulting in a situation such as is shown in FIG. 4. Movement of the slide being blocked by the ratchet, frame 107 has moved relative to the slide, cocking hammer 113 and causing barrel 103 to protrude into space provided for it in the sheath.

Figure 4:
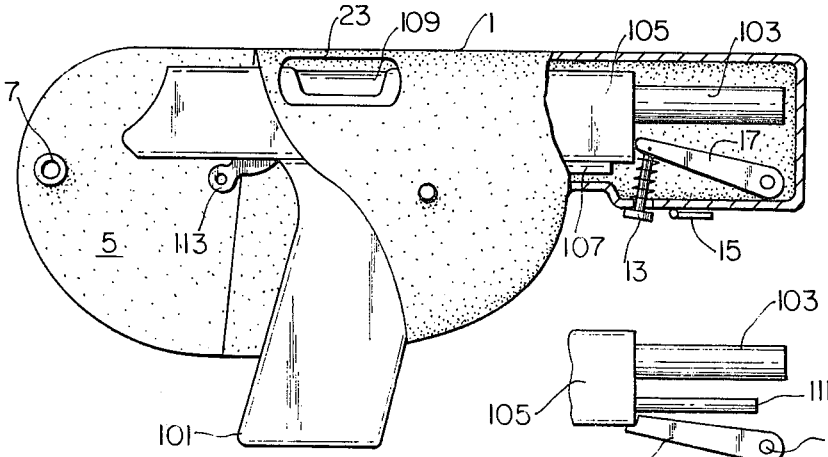
FIG. 4 is a partly sectioned view of a holster incorporating a ratchet, showing a pistol being charged.

The first motion of charging having been accomplished as shown in FIG. 4, the pistol is then drawn completely from the holster, whereupon the recoil spring (not shown) in the pistol will cause the second charging motion, which is the return of the slide to its forward position in the usual manner. The pistol will then be ready to fire, a cartridge having been rammed into the chamber by the slide and the hammer having been cocked.

If for any reason the charging process is accomplished while a cartridge is in the firing chamber, the cartridge will be ejected via ejection port 109 in the slide and hole 23 in the holster. If no means were provided for ejection via the holster and the user should forget that a cartridge is in the chamber, an attempt to charge would result in a jam, as the ejected cartridge would be held in port 109 by the holster. Hence the necessity for hole 23. When the holster is closed, flap 5 covers hole 23.

As may be seen in FIG. 4, when the frame of the pistol is completely inserted into the holster access to the trigger is blocked. This is necessary because on most pistols the trigger is disconnected during charging. If the trigger should be held back during charging, time would be lost when charging is finished because it would be necessary to release the trigger and then pull it, to fire.

Figure 5:
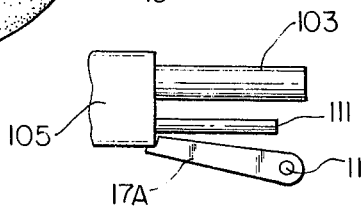
FIG. 5 is an alternate arrangement of the ratchet to accommodate some pistols.

Some pistols have a rod such as 111 which guides an internal recoil spring and, like the barrel protrudes from the front of the slide during the charging process. An example is shown in FIG. 5. For such a situation, a blocking means such as ratchet 17A can be arranged to engage the slide at any convenient surface where it will not interfere with the rod. Of course, the configuration of the holster and of the blocking means must be so chosen as to be compatible with the particular pistol used.

Furthermore, some pistols have slides which do not extend the full length of the pistol. The method of charging is not affected thereby but in using the present invention with such a pistol the ratchet or other blocking means must be suitably positioned in the holster at a place where it can engage the slide.

The holster can be so dimensioned relative to the size and shape of the pistol that flap 5 cannot be completely closed unless the slide is disengaged from the ratchet or other blocking means. This is disclosed in FIG. 4.

It is not intended to limit the invention to the precise form of ratchet disclosed in the drawings. Any of a considerable range of mechanical equivalents could be used to block movement of the slide during charging. The ratchet shown was merely selected for convenience.

There is thus disclosed a simple charging device which permits a pistol to be charged with one hand, while ordinarily two hands must be used. The disclosure is exemplary only, and should not be considered limiting.

What I claim is:

1. A charging device for a pistol charged by relative motion between a frame and a slide comprising: a holster adapted for suspension from the person of a user and having an upper end and a lower end, said holster including means to support and guide said pistol in a slideable relationship therewith; releaseable blocking means in said holster positionally adapted for engaging said slide at a first position whereat it prevents movement of said slide toward said lower end, said blocking means also being movable to a second position whereat it cannot prevent said movement; and means to permit a barrel to protrude from the front of said slide when said slide is engaged by said blocking means.

2. A charging device as set forth in claim 1 further characterized by said blocking means comprising ratchet means.

3. A charging device as set forth in claim 2 further characterized by means for normally biasing said ratchet means toward said first position.

4. A charging device as set forth in claim 2 further characterized by means for manually moving said ratchet means from said first position to said second position.

5. A charging device as set forth in claim 2 further characterized by means to latch said ratchet means at said second position.

6. A charging device as set forth in claim 5 further characterized by means on the exterior of said holster to indicate when said blocking means is latched at said second position.

7. A charging device as set forth in claim 1 further characterized by means to accommodate a recoil spring guide protruding from the front of said slide.

8. A charging device as set forth in claim 1 further characterized by means for blocking access to a trigger of said pistol when said frame is fully inserted into said holster.

9. A charging device as set forth in claim 1 further characterized by said holster having a hole therein adapted to register with an ejection port in said slide when said slide is engaged with said blocking means.

10. A charging device as set forth in claim 9 further characterized by said holster having means for covering said hole.

11. A charging device as set forth in calim 10 further characterized by said holster having a flap which is prevented from closing by said slide when said slide is engaged with said blocking means.

* * * * *